US007395947B2

(12) United States Patent
Drennow

(10) Patent No.: US 7,395,947 B2
(45) Date of Patent: Jul. 8, 2008

(54) SPACER AT A CONNECTING DEVICE

(75) Inventor: Sten Drennow, Lund (SE)

(73) Assignee: Asept International AB, Lund (SE)

( * ) Notice: Subject to any disclaimer, the term of this patent is extended or adjusted under 35 U.S.C. 154(b) by 450 days.

(21) Appl. No.: 10/531,894

(22) PCT Filed: Oct. 22, 2003

(86) PCT No.: PCT/SE03/01629

§ 371 (c)(1),
(2), (4) Date: Apr. 20, 2005

(87) PCT Pub. No.: WO2004/037668

PCT Pub. Date: May 6, 2004

(65) Prior Publication Data

US 2006/0144856 A1 Jul. 6, 2006

(30) Foreign Application Priority Data

Oct. 24, 2002 (SE) ..... 0203130

(51) Int. Cl.
*B65D 35/28* (2006.01)
*B65D 5/60* (2006.01)

(52) U.S. Cl. ..... 222/95; 222/464.1; 222/464.3; 222/105

(58) Field of Classification Search ..... 222/95, 222/105, 107, 81, 83, 89, 91, 131, 464, 491, 222/386.5, 520, 537, 464.3, 464.4, 464.5, 222/464.2, 464.6, 464.7
See application file for complete search history.

(56) References Cited

U.S. PATENT DOCUMENTS

| | | | | |
|---|---|---|---|---|
| 4,138,036 | A | 2/1979 | Bond | |
| 4,286,636 | A * | 9/1981 | Credle | 141/114 |
| 4,375,864 | A | 3/1983 | Savage | |
| 4,949,871 | A * | 8/1990 | Flanner | 222/95 |
| 5,002,202 | A * | 3/1991 | Karpisek | 222/83 |
| 5,156,300 | A * | 10/1992 | Spahni et al. | 222/105 |

FOREIGN PATENT DOCUMENTS

| | | |
|---|---|---|
| EP | 0 367 937 A1 | 5/1990 |
| WO | WO 02/16224 A1 | 2/2002 |

* cited by examiner

*Primary Examiner*—Kevin P. Shaver
*Assistant Examiner*—Stephanie E Tyler
(74) *Attorney, Agent, or Firm*—Tarolli, Sundheim, Covell & Tummino LLP

(57) ABSTRACT

The present invention relates to a spacer at connecting devices which are adapted to connect discharge devices (2) to packages (3) with liquid products (4), preferably foodstuff products, for discharging the products (4) from the packages (3). The spacer (19) is provided on a connecting means (26) and is adapted to be located in the package (3) in order to, during emptying of the package, keep wall portions thereof at a distance from a connecting device (1) such that the wall portions do not prevent or substantially obstruct emptying of the package (3). The spacer (19) has resilient properties and can be pressed into a space (28) in a tube member (23) and spring back to a normal shape (NF).

19 Claims, 5 Drawing Sheets

SPACER AT A CONNECTING DEVICE

FIELD OF THE INVENTION

The present invention relates to a spacer at connecting devices which are adapted to connect discharge devices to packages with liquid products, preferably foodstuff products, for discharging said products from the packages, wherein the packages have walls of synthetic material.

BACKGROUND OF THE INVENTION

The connecting device is adapted to permit products to flow therethrough from the package to the discharge device. The connecting device comprises a tube member which is provided on a first wall portion of the walls of the package and it also comprises a connecting means which can be fixed to the tube member. The spacer is provided on the connecting means and is adapted to be located in the package in order to, during emptying of said package, keep wall portions thereof at a distance from the connecting device such that said wall portions do not prevent or substantially obstruct emptying of the package.

The measure to fix the connecting means with the spacer to the tube member is circumstantial, time consuming and might result in that a part of the content of the package flows out. This depends on that the spacer is rigid and thereby prevents location of the package on a support and pressing of the connecting means onto the tube member from above by means of the support. Instead, one have to lift or raise the tube member and thereby a part of the package, retain or hold on to the tube member and then press the connecting means onto the tube member when said tube member is held in the raised position.

SUMMARY OF THE INVENTION

The object of the present invention is to eliminate the abovementioned problems and this is arrived at according to the invention by the provision of the characterizing features of primarily subsequent claim 1.

While the spacer has resilient properties, it can be compressed such that it becomes possible to fix the connecting means to the tube member when the package is lying on a support. Hereby, the connecting means may with a simple manipulation be quickly fixed to the tube member without risking that larger amounts of the content of the package flows out. When the fixation of the connecting means to the tube member has been carried through, the spacer automatically transforms into its space or distance keeping shape.

BRIEF DESCRIPTION OF THE DRAWINGS

The invention will be further described below with reference to the accompanying drawings, in which.

DESCRIPTION OF EXAMPLE EMBODIMENTS

Figure 1:
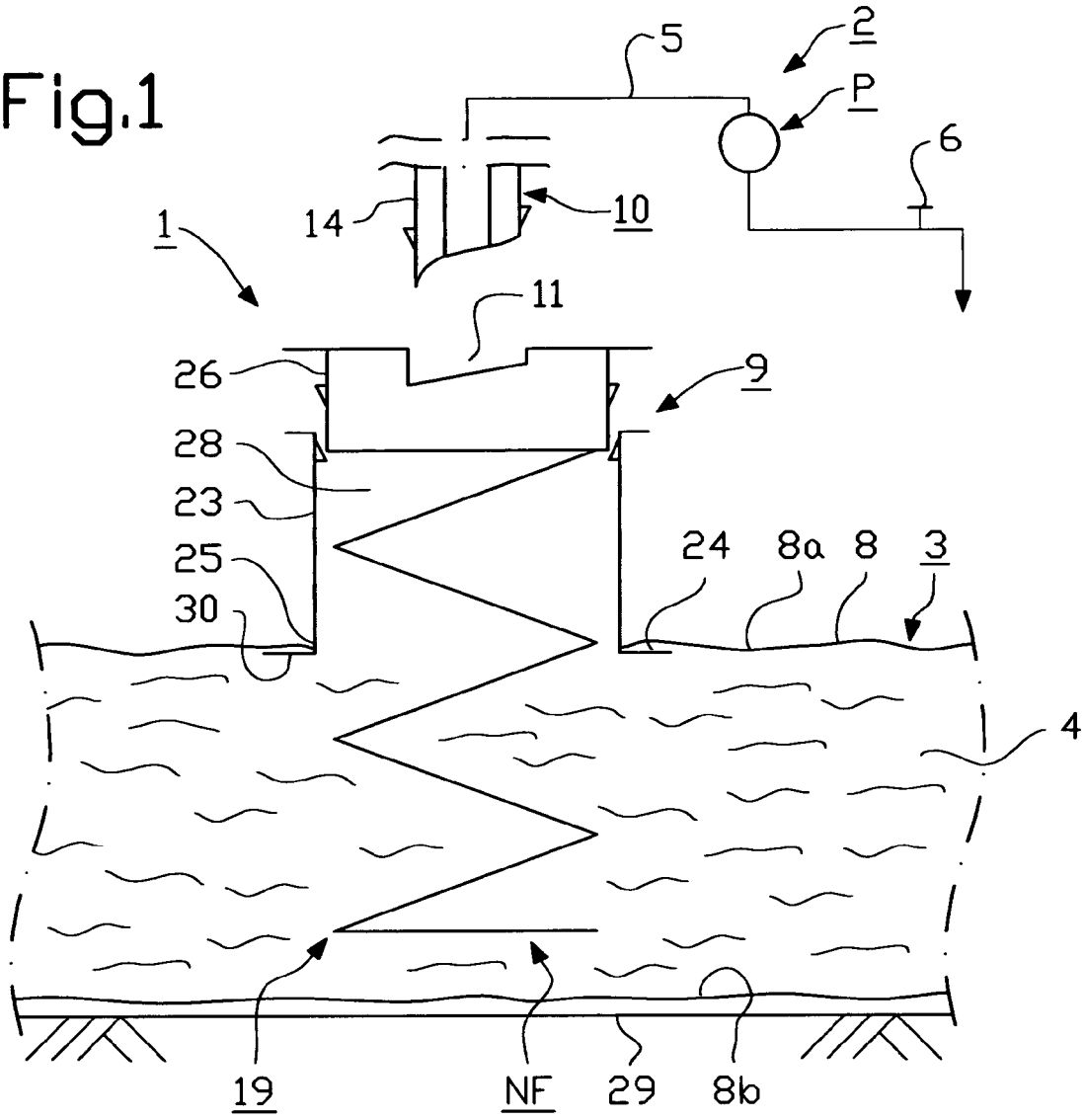
FIG. 1 is a schematic section through a part of a package with a tube member and a connecting means with a spacer, wherein the connecting means is located in a ready position for fixation thereof to the tube member.
Figure 2:
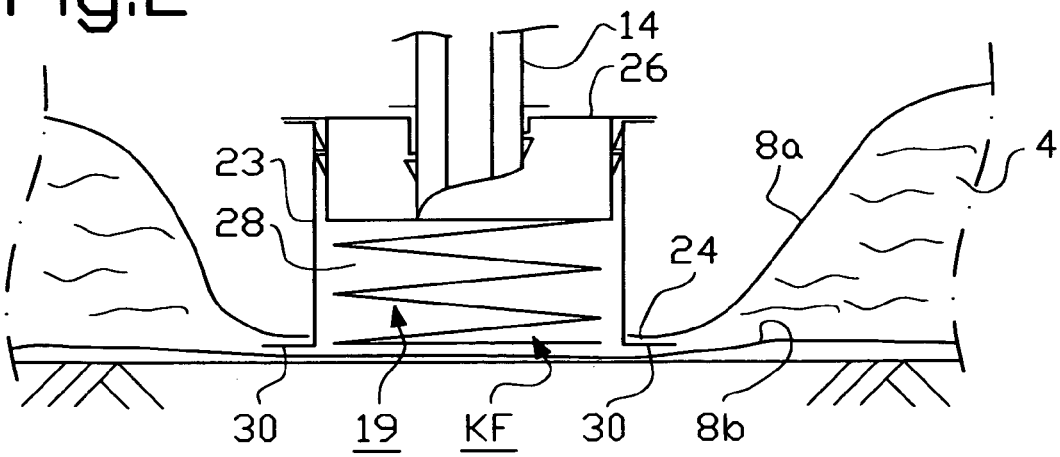
FIG. 2 shows the same section during the final phase of a fixation moment at which the connecting means is fixed to the tube member.
Figure 3:
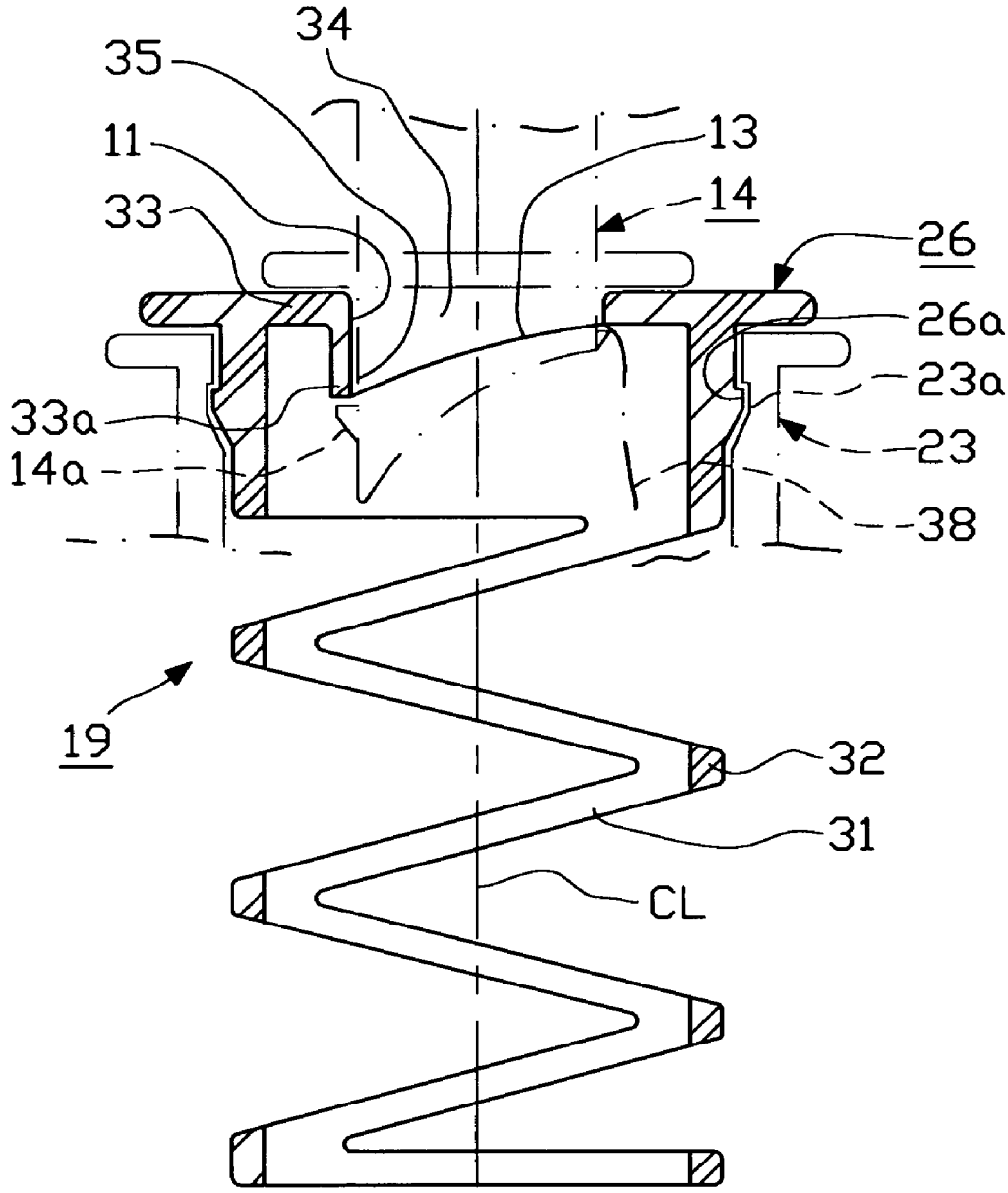
FIG. 3 is a section through the connecting means of FIGS. 1 and 2 and a tubular member connected thereto.

The connecting devices 1 illustrated in the drawings are adapted for connection of discharge devices 2 to packages 3 with liquid products 4, e.g. foodstuff products, for discharging said products 4 from the packages 3.

The discharge devices 2 may be of different types. They may e.g. consist of or include a hose 5 or similar with a tap 6 and by opening the tap 6 the product 4 can flow out of the package 3 and out through the hose 5 by self-flow. The discharge devices 2 may in another embodiment include a pump P for pumping the product 4 out of the package 3 by generating a negative pressure therein.

The package 3 has walls 8 of synthetic material and it consists preferably completely of synthetic material. The material is preferably flexible and the package 3 may be designed as a plastic bag. The package 3 can preferably be placed in a container 7.

The connecting device 1 has two connecting members 9 and 10 which can be connected to each other, namely a first connecting member 9 which is provided on a first wall portion 8*a* of a wall 8 of the package 3 and a second connecting member 10 which can be connected to the first connecting member 9 for connecting the discharge device 2 to the package 3.

The first connecting member 9 has a hole 11 or a notch for a hole 11. The hole 11 is closed by means of a closing member 13. By means of a tubular member 14 of the second connecting member 10, said closing member 13 can be penetrated and then, said tubular member 14 is insertable into the hole 11 until the connecting members 9, 10 are closely attached to each other.

Figure 4:
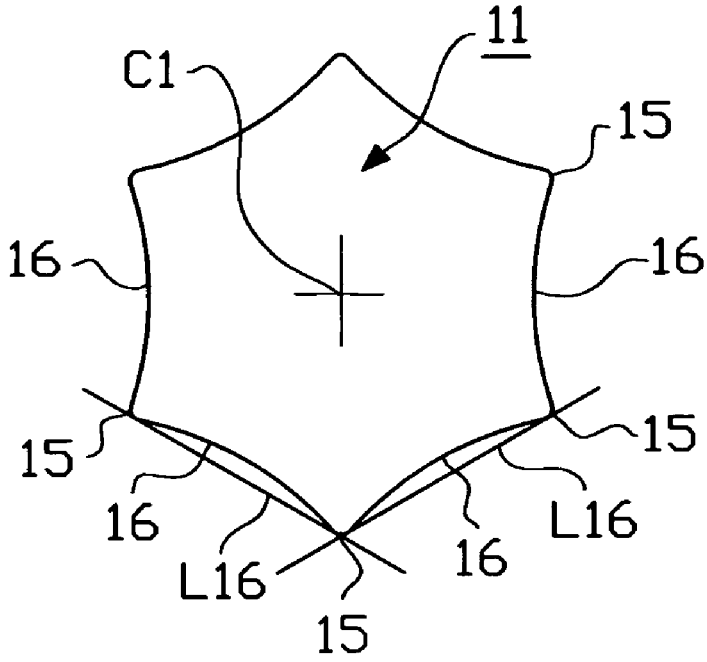
FIG. 4 illustrates an inner shape of a hole in the connecting means.
Figure 5:
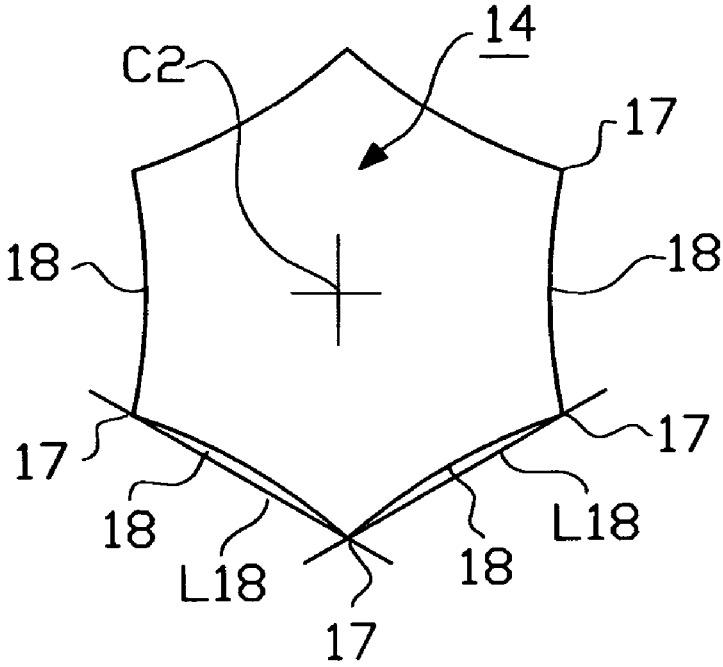
FIG. 5 illustrates the outer shape of a tubular member which shall fit into the hole of FIG. 4.
Figure 6:
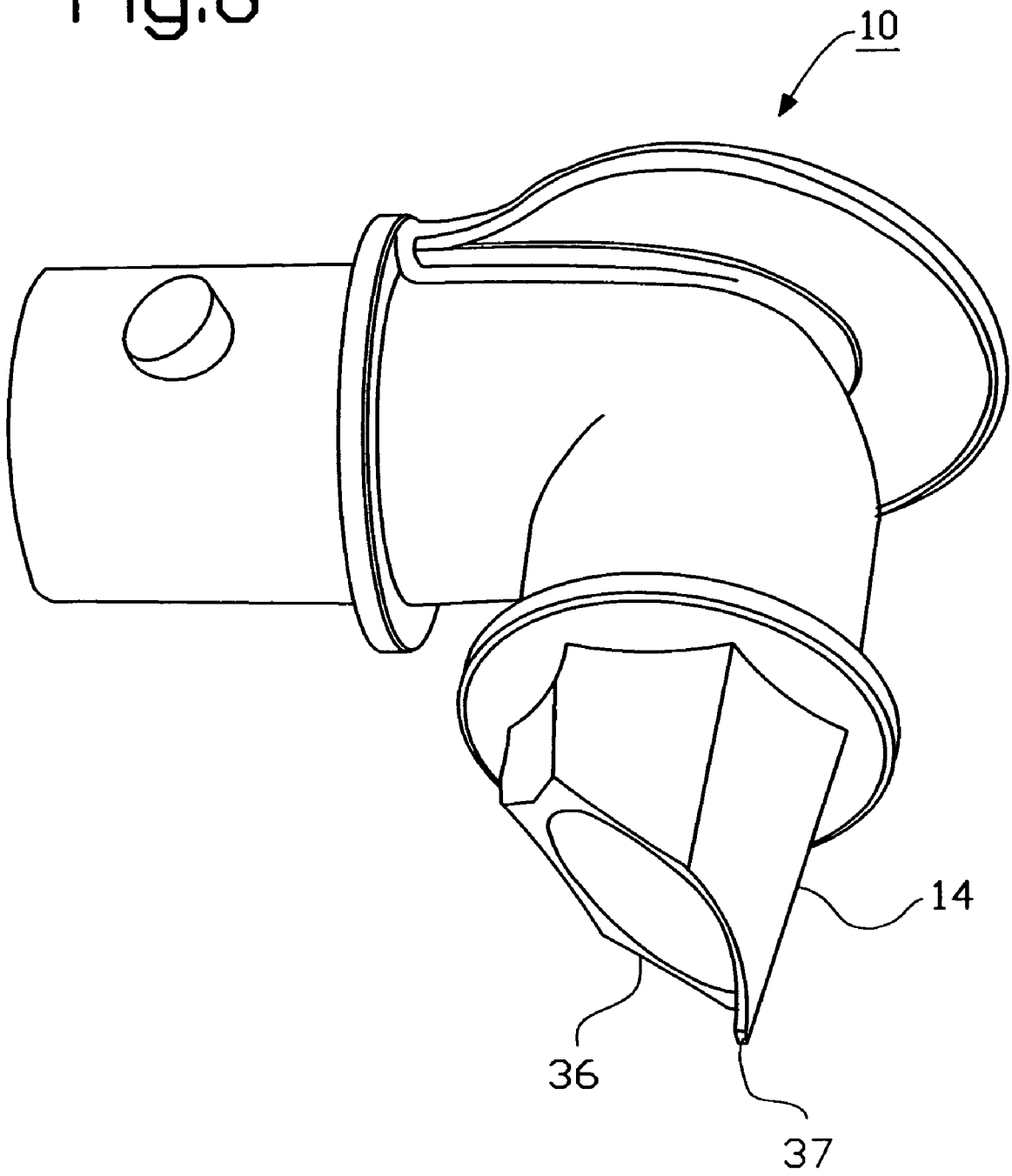
FIG. 6 illustrates the outer shape of a tubular member which can be connected to the hole of the connecting means of FIG. 4.

In the embodiment shown, the hole 11 has six corners 15, but it may alternatively have four or five corners 15. The hole 11 has edge portions 16 which extend between adjacent corners (see FIG. 4). In order to fit into such a hole 11 with six corners 15, the tubular member 14 also has six corners 17 (or four or five corners if the hole 11 has this number of holes) and edge portions 18 between these corners 17 (see FIG. 5).

The edge portions 16 of the hole 11 may be inwardly directed and/or include members or portions which are directed inwards towards the centre C1 of the hole 11 relative to straight geometric lines L16 which connect adjacent corners 15 between the edge portions 16 to each other. The edge portions 18 of the tubular member 14 are in a corresponding manner directed inwards and/or include members or portions directed inwards towards the centre C2 of the tubular member 14 relative to straight geometric lines L18 which connect adjacent corners 17 between the edge portions 18 to each other.

In the embodiment shown, the edge portions 16 and 18 respectively, of the hole 11 and the tubular member 14 respectively, define concave arcs relative to the centre C1 and C2 respectively, of said hole 11 and said tubular member 14 respectively, and all these arcs may be uniform.

The inwardly directed edge portions 16, 18 may however be designed in other ways than concave arcs and they need not be uniform between all corners.

The first connecting member 9 may be provided in such a definite way on the package 3 that the edge portion 16 of its hole 11 get a predetermined orientation relative to the package 3.

The first connecting member 9 includes a tube member 23 which preferably has an annular flange 24 at one of its end portions. The annular flange 24 is provided inside the package 3 and it is situated on the inner side of the wall 8, e.g. by means of welding, around a hole 25 in the wall 8. The tube member 23 is directed out of the package 3 through the hole 25 and it is situated at least partly outside said package 3.

The tube member 23 is provided with a cap (not shown) when the package 3 has been filled with product 4 and the cap remains seated on the tube member 23 during transport and storage of the filled package 3.

When the package 3 shall be connected to the discharge device 2 for discharge of the product 4 from the package 3, the cap is removed from the tube member 23, a connecting means 26 is connected to the tube member 3, the connecting means 26 is opened by means of the tubular member 14 of the second connecting member 10 and said tubular member 14 is fixed to the connecting means 26. Hereby, the package 3 has been opened and the discharge device 2 is connected thereto for discharge of the product 4. The connecting means 26 is provided with the hole 11 or the notch therefor and the hole 11 is closed by means of the closing member 13.

The connecting means 26 has a spacer 19 with resilient properties in a direction in parallel with a longitudinal centre line CL. This spacer 19 is adapted to be situated in the package 3 in order to, during emptying thereof, keep wall portions—inter alia the second wall portion 8*b*—at a distance from the tube member 23 such that said wall portions 8*b* do not obstruct product 4 which shall be discharged from the package 3. When the connecting means 26 is fixed to the tube member 23 and the spacer 19 is in a stretched normal shape NF, it is situated in the package 3 and extends from the connecting means 26 in a direction towards the second wall portion 8*b*. The spacer 19 may, due to its resilient properties, be compressed into a compressed shape KF and the tube member 23 has a space 28 which is designed to receive the spacer 19 when said spacer is in a totally or at least partly compressed shape.

In order to fix the connecting means 26 to the tube member 23, the package 3 is placed on a support 29 such that it through a second wall portion 8*b* engages said support and such that the first wall portion 8*a* with the tube member 23 is directed upwards. Then, the connecting means 26 is connected to the tube member 23, here by insertion into said tube member 23. By pressing the connecting means 26 downwards in direction A, preferably by means of the tubular member 14, the tube member 23 will be brought along in said direction A due to the friction between the connecting means 26 and the tube member 23. Product 4 under the tube member 23 will thereby be pressed aside and the spacer 19 will engage the second wall portion 8*b* and the support 29 through said second wall portion 8*b*.

By continuing to press the connecting means 26 and the tube member 23 in direction A against the support 29, the spacer 19 is compressed and will be pressed into the space 28 in the tube member 23. The tube member 23 has an inner, annular application surface 30 and during continued pressing of the connecting means 26 and tube member 23 in direction A against the support 29, the application surface 30 engages the second wall portion 8*b*. When this occurs, the support 29 prevents the tube member 23 from continuing its downward movement and the connecting means 26 can be pressed down relative to the tube member 23 such that the connecting means 26 can be fixed to the tube member 23, preferably by a snap-in action therewith. In order to make this snap-in action possible, the tube member 23 may have a snap-in portion 23*a* which can cooperate with a snap-in portion 26*a* of the connecting means 26.

By continuing to press the tubular member 14 down against the closing member 13 when the connecting means 26 is fixed to the tube member 23 and said tube member 23 is supported by the support 29, the closing member 13 can be brought to rupture such that the hole 11 is opened, and the tubular member 14 can then be fixed to the outer wall portion 33, e.g. by a snap-in action by means of snap-in portions 14*a*, 33*a* or other suitable means. Alternatively, this opening or making of a hole in the closing member 13 may occur during the downward pressing of the connecting means 26 and the tube member 23, i.e. before fixation of the connecting means 26 to the tube member 23.

It is however also possible first to press the connecting means 26 along with the tube member 23 downwards until the connecting means 26 is fixed to the tube member 23 and retain these members in downwardly pressed position, and then press the tubular member 14 downwards such that it penetrates the closing member 13, and until the tubular member 14 is fixed to the connecting means 26.

Thereby, the connecting means 26 is fixed close to the tube member 23 and the tubular member 14 to the connecting means 26. When one ceases to press down the tubular member 14, connecting means 26 and tube member 23, the spacer 19 can spring back and thereby return to its normal shape NF and thus, its distance keeping position such that wall portions of the package 3, e.g. the second wall portion 8*b*, can not come close to the hole through which the package 3 is emptied.

The application surface 30 of the tube member 23 is preferably designed such that it can be applied in close or substantially close engagement with the second wall portion 8*b* and maintain this position when the connecting means 26 by a snap-in action is attached to the tube member 23. By cooperation between the application surface 30 and the second wall portion 8*b*, atmospheric air which during said fixing operation eventually is present in the tube member 23 is prevented or at least substantially obstructed from flowing into and contaminate the product 4 in the package 3 around the tube member 23.

Thanks to its resiliency, the spacer 19 may also contribute to a pump effect when the product 4 is discharged from the package 3 in portions by means of the pump P. This is accomplished while the second wall portion 8*b* of the package 3 cooperates with the spacer 19 such that when the pump P generates a negative pressure in the package 3, said package 3 is deflated or contracted, whereby the second wall portion 8*b* is sucked towards the spacer 19 and compresses it. When the negative pressure in the package 3 ceases after a pump stroke, the suction effect on the second wall portion 8*b* also comes to an end, whereby the spacer 19 can spring back to normal shape NF, thereby pressing back the second wall portion 8*b*. Hereby, said second wall portion 8*b* is subjected or imparted to pump movements which affect the product 4 in the package 3 such that emptying of the package 3 is facilitated.

The spacer 19 may e.g. consist of synthetic material with resilient properties. It can be designed with or include a number of annular parts 31 arranged in stagger and connected with other parts of the connecting means 26 and with each other through connecting members 32 having resilient properties. The annular parts 31 may also have resilient properties.

The closing member 13 may be inclined relative to the geometric axial centre line CL of the hole 11 and define the bottom of an outwardly open recess 34 which defines a deep part 35 which is eccentric relative to the centre line CL of the hole 11.

The tubular member 14 has an end edge 36 which is inclined relative to the geometric axial centre line CL of the tubular member 14. This inclined end edge 36 forms a tip or point 37 which is eccentric relative to the centre line CL and when the tubular member 14 is inserted into the hole 11, it is guided by the inclined closing member 13 such that said tip or point 37 reaches the deep part 35 of the hole 11.

When the tubular member 14 has reached said position in the hole 11, it can be brought to open the closing member 13 by penetrating said closing member 13. When this is done, the closing member 13 is moved aside until it hangs into the package 3 at the side of the closing member 13 as a lip 38. The tubular member 14 withholds this lip 38 such that it does not prevent discharge of the product 4 through the hole 11.

The first connecting member 9 may instead of the hole 11 have notches therefor and the closing member 13 may in such an embodiment be provided to fill the space between said notches and it may be penetrated by means of the tubular member 14. In such an embodiment, the first connecting member 9 and the closing member 13 may be designed as a unit or the closing member 13 may be attached to the first connecting member 9 and cover the notch.

Figure 7:
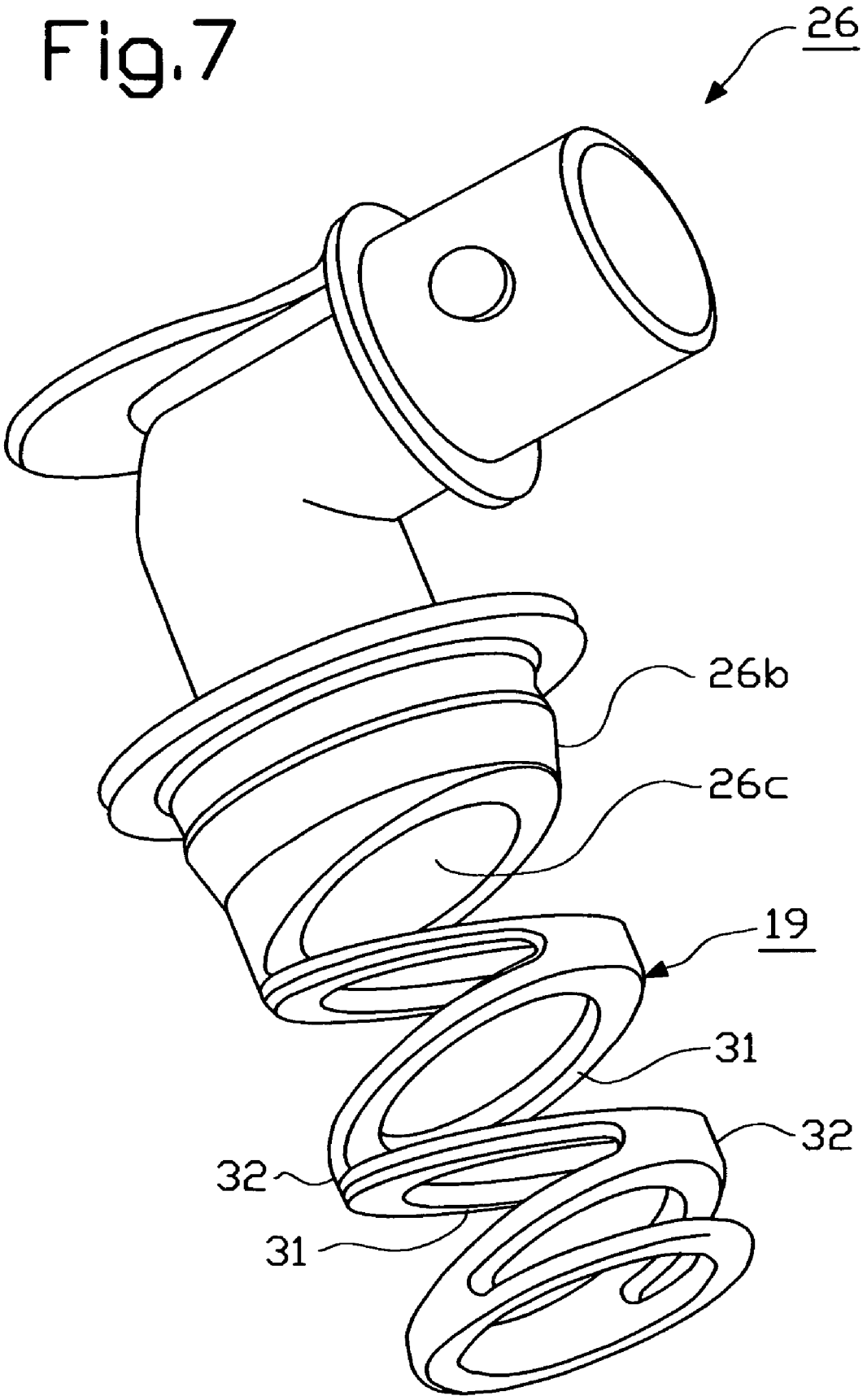
FIG. 7 is a perspective view of an alternatively designed connection means.

As is apparent from FIG. 7, the connecting means 26 may be a tube having a connecting portion 26*b* for direct connection and fixation to the tube member 23 and being provided with a through passage 26*c* which is preferably open.

The invention is not limited to the embodiments described above and shown in the drawings, but may vary within the scope of the following claims. It should e.g. be mentioned that the package 3 may contain other liquid or semi-liquid products than foodstuff, such as e.g. pharmaceutical products or glue products. It should finally be mentioned that the annular parts 31 of the spacer 19 can be connected to each other by means of thin flexible strings (not shown) which do not obstruct its resilient properties but prevent the annular parts 31 from hooking on to each other at assortment thereof during manufacture of the package 3.

The invention claimed is:

1. An apparatus comprising a spacer and a connecting device which is adapted to connect a discharge device (2) to a package (3) with liquid products (4), for discharging said products (4) from the package (3), wherein the package (3) has walls (8) of synthetic material, wherein the connecting device (1) is adapted to permit products (4) to flow therethrough from the package (3) to the discharge device (2), wherein the connecting device (1) comprises a tube member (23) which is provided on a first wall portion (8*a*) of the walls of the package (3), wherein the connecting device (1) comprises a connecting means (26) which is fixed to the tube member (23), and wherein the spacer (19) is provided on the connecting means (26) and adapted to be located in the package (3) in order to, during emptying of said package, keep wall portions thereof at a distance from the connecting device (1) such that said wall portions do not prevent or substantially obstruct emptying of the package, the spacer (19) has resilient properties, the connecting device (1) includes a tubular member (14) which is fixed to the connecting means (26), the connecting means (26), for fixation thereof to the tube member (23), is brought to cooperate therewith by means of the tubular member (14) of the connecting device (1) such that it the tube member (23) is pressed downwards with the connecting means (26) in a direction towards a support (29) on which the package (3) is placed with a second wall portion (8*b*) thereof, the spacer (19) by said downward pressing is brought to engage the support (29) through the second wall portion (8*b*) such that said spacer (19) at continued downward pressing is compressed from a normal shape (NF) to a compressed shape (KF), the tube member (23) having a space (28) in which the spacer (19) is received when it is compressed and in which it is accommodated in compressed shape (KF), that the connecting means (26) being fixed to the tube member (23) when said connecting means (26) is pressed downwards relative to the tube member (23) and said tube member (23) engages the support (29) through said second wall portion (8*b*), and the spacer (19) being provided to spring back to its normal shape (NF) when the downward pressing of the connecting means (26) and the tube member (23) ceases such that said spacer (19) can take up a distance keeping position.

2. The apparatus of claim 1, characterized in that the tube member (23) has an annular application surface (30) which can be applied close or substantially close to the second wall portion (8*b*) when the connecting means (26) and the tube member (23) are pressed in a direction towards the support (29), such that said application surface (30), in cooperation with the second wall portion (8*b*), prevents or at least obstructs atmospheric air from penetrating into the package (3) through the tube member (23) and contaminating the product (4) in the package (3).

3. The apparatus of claim 1, characterized in that the spacer (19) and the second wall portion (8*b*) cooperate with each other such that the second wall portion (8*b*) compress the spacer (19) when said second wall portion (8*b*) is pressed against said spacer (19) during deflation or contraction of the package (3) due to generation of a negative pressure therein when product (4) is discharged therefrom, and that the spacer (19) brings back the second wall portion (8*b*) by springing back when said suction or contraction force acting on the second wall portion (8*b*) ceases such that said second wall potion (8*b*), during discharge of product (4) from the package (3), performs pump movements which affect the product (4) such that discharge thereof is facilitated.

4. The apparatus of claim 1, characterized in that the spacer (19) includes annular parts (31) which are arranged in stagger and connected with each other through connecting members (32) having resilient properties, and that the spacer (19) is compressible and expands in axial directions relative to the annular parts (31).

5. The apparatus of claim 1, characterized in that the connecting means (26) can be fixed to the tube member (23) through a snap-in connection therewith.

6. The apparatus of claim 1, characterized in that the tubular member (14) can be fixed to the connecting means (26) while the connecting means (26) and the tube member (23) are pressed downwards in a direction towards the support (29) or by continue to press the tubular member (14) in a direction towards the support (29) when the tube member (23) engages said support (29) through the second wall portion (8*b*).

7. The apparatus of claim 1, characterized in that the tubular member (14), by pressing thereof against a closing member (13) on the connecting means (26) and in a direction towards the support (29), penetrates said closing member (13)

and can be pressed, e.g. by a snap-in action, onto the connecting means (26) when said connecting means (26) has been fixed to the tube member (23) and said tube member (23) is supported by the support (29) through the second wall portion (8*b*).

8. The apparatus of claim 6, characterized in that the tubular member (14), by pressing thereof against a closing member (13) on the connecting means (26) and in a direction towards the support (29), penetrates said closing member (13) and can be pressed, e.g. by a snap-in action, onto the connecting means (26) when the connecting means (26) and the tube member (23) are pressed in a direction towards the support (29) but before said connecting means (26) is fixed to said tube member (23).

9. The apparatus of claim 1, characterized in that the connecting means (26) has a hole (11) and a member (13) closing said hole (11), and that the closing member (13) can be penetrated by means of the tubular member (14).

10. The apparatus of claim 9, characterized in that the closing member (13) is inclined relative to a geometric axial centre line (CL) of the hole (11) such that it defines a deep part (35) which is eccentric relative to the centre line (CL) of the hole (11), that the tubular member (14) has an end edge (36) which is inclined relative to a geometric axial centre line (CL) of the tubular member (14) and forms a tip or point (37) which is eccentric relative to said centre line (CL), and that the tip or point (37) is provided to be guided into said deep part (35) when the tubular member (14) is inserted into the hole (11).

11. The apparatus of claim 9, characterized in that the tubular member (14) can be inserted into the hole (11) and pressed onto edge portions (16) of the hole (11) such that the tubular member (14) adheres to said edge portions (16) and such that connecting members (9, 10) of the connecting device (1) adhere close to each other, that the hole (11) in the first connecting member (9) has four, five or six corners (15) and edge portions (16) which extend between said corners (15), that the tubular member (14) of the second connecting member (10) has a corresponding number of corners (17) and edge portions (18) extending therebetween, that the edge portions (16) of the hole (11), relative to straight geometric lines (L16) which connect adjacent corners (15) between the edge portions (16) of the hole (11) with each other, are inwardly directed and/or include parts which are inwardly directed towards the centre (Cl) of the hole, and that the edge portions (18) of the tubular member (14), relative to straight geometric lines (L18) which connect adjacent corners (17) between the edge portion (18) of the tubular member (14) with each other, are inwardly directed and/or include parts which are inwardly directed towards the centre (C2) of the tubular member (14).

12. The apparatus of claim 11, characterized in that the edge portions (16 and 18 respectively) of the hole (11) and the tubular member (14) respectively, are concave and arcuate relative to the centre (C1 and C2 respectively) of said hole (11) and said tubular member (14).

13. The apparatus of claim 11, characterized in that the edge portions (16 and 18 respectively) of the hole (11) and the tubular member (14) respectively, are uniform.

14. The apparatus of claim 11, characterized in that the first connecting member (9) is provided on the package (3) such that the edge 35 portions (16) of its hole (11) has a certain orientation relative to the package (3).

15. The apparatus of claim 1, characterized in that the connecting means (26) includes a connecting portion (26*b*) for direct connection and fixation to the tube member (23) and that the connecting means (26) is a tube having a through passage (26*c*).

16. The apparatus of claim 1, characterized in that the first and the second connecting member (9, 10) respectively, comprises elastic material or has at least at the hole (11) and the tubular member (14) respectively, elastic material.

17. The apparatus of claim 1, characterized in that the first and second connecting member (9, 10) comprise synthetic material.

18. The apparatus of claim 1, characterized in that the package (3) comprises flexible material and is designed as a plastic bag.

19. An apparatus comprising a spacer and a connecting device which is adapted to connect a discharge device (2) to a package (3) with liquid products (4) for discharging said products (4) from the package (3), wherein the package (3) has walls (8) of synthetic material, wherein the connecting device (1) is adapted to permit products (4) to flow therethrough from the package (3) to the discharge device (2), wherein the connecting device (1) comprises a tube member (23) which is provided on a first wall portion (8*a*) of the walls of the package (3), wherein the connecting device (1) comprises a connecting means (26) including a connecting portion (26*b*) for direct connection and fixation to the tube member (23), the connecting means (26) comprising a tube having a through passage (26*c*), and wherein the spacer (19) is provided on the connecting means (26) and adapted to be located in the package (3) in order to, during emptying of said package, keep wall portions thereof at a distance from the connecting device (1) such that said wall portions do not prevent or substantially obstruct emptying of the package, the spacer (19) has resilient properties, the connecting means (26), for fixation thereof to the tube member (23), is brought to cooperate therewith such that it moves with the connecting means (26) in a direction towards a support (29) on which the package (3) is placed with a second wall portion (8*b*) thereof, the spacer (19) by said downward pressing is brought to engage the support (29) through the second wall portion (8*b*) such that said spacer (19) at continued downward pressing is compressed from a normal shape (NF) to a compressed shape (KF), the tube member (23) having a space (28) in which the spacer (19) is received when it is compressed and in which it is accommodated in compressed shape (KF), the connecting means (26) being fixed to the tube member (23) when said connecting means (26) is pressed downwards relative to the tube member (23) and said tube member (23) engages the support (29) through said second wall portion (8*b*), and the spacer (19) being provided to spring back to its normal shape (NF) when the downward pressing of the connecting means (26) and the tube member (23) ceases such that said spacer (19) can take up a distance keeping position.

* * * * *